US008328046B2

(12) United States Patent
Hochtritt et al.

(10) Patent No.: US 8,328,046 B2
(45) Date of Patent: Dec. 11, 2012

(54) DISPENSER FOR FOLDED ABSORBENT SHEET PRODUCTS

(75) Inventors: Robert C. Hochtritt, Neenah, WI (US); Andrew M. Conger, Neenah, WI (US)

(73) Assignee: SCA Tissue North America LLC, Philadelphia, PA (US)

( * ) Notice: Subject to any disclaimer, the term of this patent is extended or adjusted under 35 U.S.C. 154(b) by 2410 days.

(21) Appl. No.: 10/660,659

(22) Filed: Sep. 12, 2003

(65) Prior Publication Data

US 2005/0056657 A1 Mar. 17, 2005

(51) Int. Cl.
*B65H 1/00* (2006.01)

(52) U.S. Cl. ..... 221/285; 221/33; 221/41; 221/282

(58) Field of Classification Search ..... 221/45, 221/55, 47, 63, 284, 285, 44, 282, 33, 41; 312/50, 60; 248/346.1, 346.01
See application file for complete search history.

(56) References Cited

U.S. PATENT DOCUMENTS

| | | | | | |
|---|---|---|---|---|---|
| 340,355 | A | * | 4/1886 | Ramsee | 221/59 |
| 744,047 | A | * | 11/1903 | Casterline et al. | 221/53 |
| 1,111,962 | A | * | 9/1914 | Hooper | 221/47 |
| 1,151,064 | A | * | 8/1915 | Swift | 221/63 |
| 1,333,045 | A | | 3/1920 | Swift | |
| 1,503,241 | A | | 7/1924 | Horwitt | |
| 1,508,020 | A | | 9/1924 | Horwitt | |
| 1,513,792 | A | | 11/1924 | Arelt | |
| 1,563,078 | A | | 11/1925 | Erdos | |
| 1,784,836 | A | | 12/1930 | Hess | |
| 1,898,983 | A | * | 2/1933 | Wheeler, Jr. | 221/48 |
| 3,652,174 | A | | 3/1972 | Boone | |
| 4,526,291 | A | * | 7/1985 | Margulies | 221/63 |
| D282,574 | S | * | 2/1986 | Case et al. | D24/185 |
| 4,638,921 | A | * | 1/1987 | Sigl et al. | 221/1 |
| D310,923 | S | * | 10/1990 | Breger | D6/522 |
| 5,090,592 | A | * | 2/1992 | Petterson et al. | 221/55 |
| 5,100,020 | A | * | 3/1992 | Petterson et al. | 221/45 |
| 5,102,007 | A | * | 4/1992 | Petterson et al. | 221/6 |
| 5,199,599 | A | | 4/1993 | Shade et al. | |
| 5,586,685 | A | | 12/1996 | Remsing et al. | |
| 6,230,929 | B1 | | 5/2001 | Lewis et al. | |
| 6,334,544 | B1 | | 1/2002 | Yardley et al. | |
| D463,184 | S | | 9/2002 | Lilley et al. | |
| 6,542,641 | B1 | * | 4/2003 | Andrew et al. | 382/233 |
| 6,830,151 | B2 | * | 12/2004 | Spencer et al. | 206/499 |
| 6,892,898 | B1 | * | 5/2005 | Boone et al. | 221/36 |
| 6,988,635 | B2 | * | 1/2006 | Hochtritt et al. | 221/44 |
| 2001/0020624 | A1 | | 9/2001 | Hubanks et al. | |

(Continued)

FOREIGN PATENT DOCUMENTS

| | | |
|---|---|---|
| DE | 195 14 431 | 11/1995 |

(Continued)

*Primary Examiner* — Timothy Waggoner
(74) *Attorney, Agent, or Firm* — Young & Thompson

(57) ABSTRACT

A napkin dispenser has a body and a stand that supports the dispenser on a horizontal surface. The body has two main sections, a first upstream section that is straight and extends over the majority of the length of said body, and a second downstream section that extends at an angle relative to the first section and communicates with a dispensing opening. When the dispenser is supported by the stand on a horizontal surface, each of the first and second sections forms an oblique angle relative to the horizontal surface, with the first section forming an angle that is more nearly vertical, and the second section forming an angle that is more nearly horizontal.

16 Claims, 4 Drawing Sheets

U.S. PATENT DOCUMENTS

| | | | | |
|---|---|---|---|---|
| 2002/0070228 | A1 | 6/2002 | Moody | |
| 2002/0139813 | A1 | 10/2002 | Kilgore et al. | |
| 2002/0179624 | A1 | 12/2002 | Tramontina et al. | |
| 2003/0062375 | A1 | 4/2003 | Moody et al. | |
| 2003/0071050 | A1 | 4/2003 | Clark | |
| 2003/0080137 | A1 | 5/2003 | Taylor et al. | |
| 2003/0116580 | A1 | 6/2003 | Baughman | |
| 2005/0150898 | A1 * | 7/2005 | Young et al. | 221/53 |

FOREIGN PATENT DOCUMENTS

| | | |
|---|---|---|
| FR | 2 538 695 | 7/1984 |
| FR | 2 732 579 | 10/1996 |

* cited by examiner

DISPENSER FOR FOLDED ABSORBENT SHEET PRODUCTS

BACKGROUND OF THE INVENTION

1. Field of the Invention

The invention relates to a dispenser for folded absorbent sheet products, preferably paper napkins.

2. Description of Related Art

Paper napkin dispensers used in commercial establishments include the widely used dispensers wherein a spring-loaded plate urges a stack of napkins along an entirely horizontal path toward a dispensing opening. In such dispensers, the amount of counter space occupied by the dispenser is at least equal to the length of the napkin stack plus the thickness of the surrounding housing structure. As a result, such dispensers tend to have a relatively low capacity, so as to occupy an acceptably small area of counter space. Low capacity napkin dispensers have drawbacks that include that they must be refilled more often by the personnel of the establishment, and are more likely to be empty when the customer seeks to use them. Each refilling operation typically results in a certain fixed amount of wasted napkins near the ends of the inserted stack, so a dispenser that must be refilled more often would be expected to suffer a higher ratio of waste product to useable product.

Napkin dispensers in which the napkin stack travels entirely vertically downwardly toward a downwardly-directed dispensing opening, also reveal certain limitations with respect to their ability to be positioned on a horizontal supporting surface. A downwardly-directed dispensing opening must for hygiene purposes be positioned sufficiently high above the horizontal surface supporting the dispenser, so that a user when withdrawing one or more napkins from the dispenser, preferably touches only the fresh napkin(s) to be withdrawn, and not the underlying counter surface or the surrounding dispenser housing. That calls for a relatively tall stand, which, when combined with a relatively high-capacity dispenser body, results in an overall dispenser structure having an undesirably high center of gravity. An example of such a dispenser is shown in U.S. design Pat. No. D463,183 in the name of Tramontina. Such dispensers therefore require that the base either be bolted to the supporting surface, or that the base be made sufficiently large and heavy to prevent the dispenser from tipping over when in use.

U.S. Pat. Nos. 5,100,020 and Des. 331,515 show a napkin dispenser in which the dispenser body follows a continuous curve, to hold a stack of off-fold napkins that, in the absence of outside forces, follows a curve having a predetermined radius of curvature matching that of the dispenser; however, such a dispenser would be expected to be somewhat awkward for use with napkins that are folded such that the unbiased stack orientation is straight.

SUMMARY OF THE INVENTION

It is therefore an object of the invention to address and alleviate, at least in part, the disadvantages described above in connection with the prior art, by providing a dispenser for holding and dispensing folded absorbent sheet products, the dispenser comprising a body and a stand, the stand comprising a base for supporting the dispenser on a horizontal surface, the body comprising two main sections, wherein a first upstream one of the sections is straight and extends over the majority of the length of the body, and wherein a second downstream one of the sections extends at an angle relative to the first section and communicates with a dispensing opening, and wherein, when the dispenser is supported by the stand on the horizontal surface, each of the first and second sections forms an oblique angle relative to the horizontal surface, the first section forming an angle that is more nearly vertical, and the second section forming an angle that is more nearly horizontal.

The dispenser stand may be formed in one piece with or be permanently secured to the main body of the dispenser; preferably, however, the stand is detachable from said body. When the stand is detachable from the body, the body then preferably comprises mounting structures for mounting the dispenser body on a vertical surface, such that the first straight section extends parallel to the vertical surface. Such an arrangement is considered to be particularly advantageous in fast food establishments, wherein the dispenser could be used with the stand for indoor countertop used, or, alternatively, mounted to an exterior wall surface for use in an outdoor drive-through lane.

BRIEF DESCRIPTION OF THE DRAWINGS

Other objects, features and advantages of the invention will become more apparent after reading the following detailed description of preferred embodiments of the invention, given with reference to the accompanying drawings, in which:

FIG. 4(*b*) is a schematic cross-sectional view of the napkin stack housed in the dispenser of FIG. 1.

DETAILED DESCRIPTION OF PREFERRED EMBODIMENTS

Figure 1:
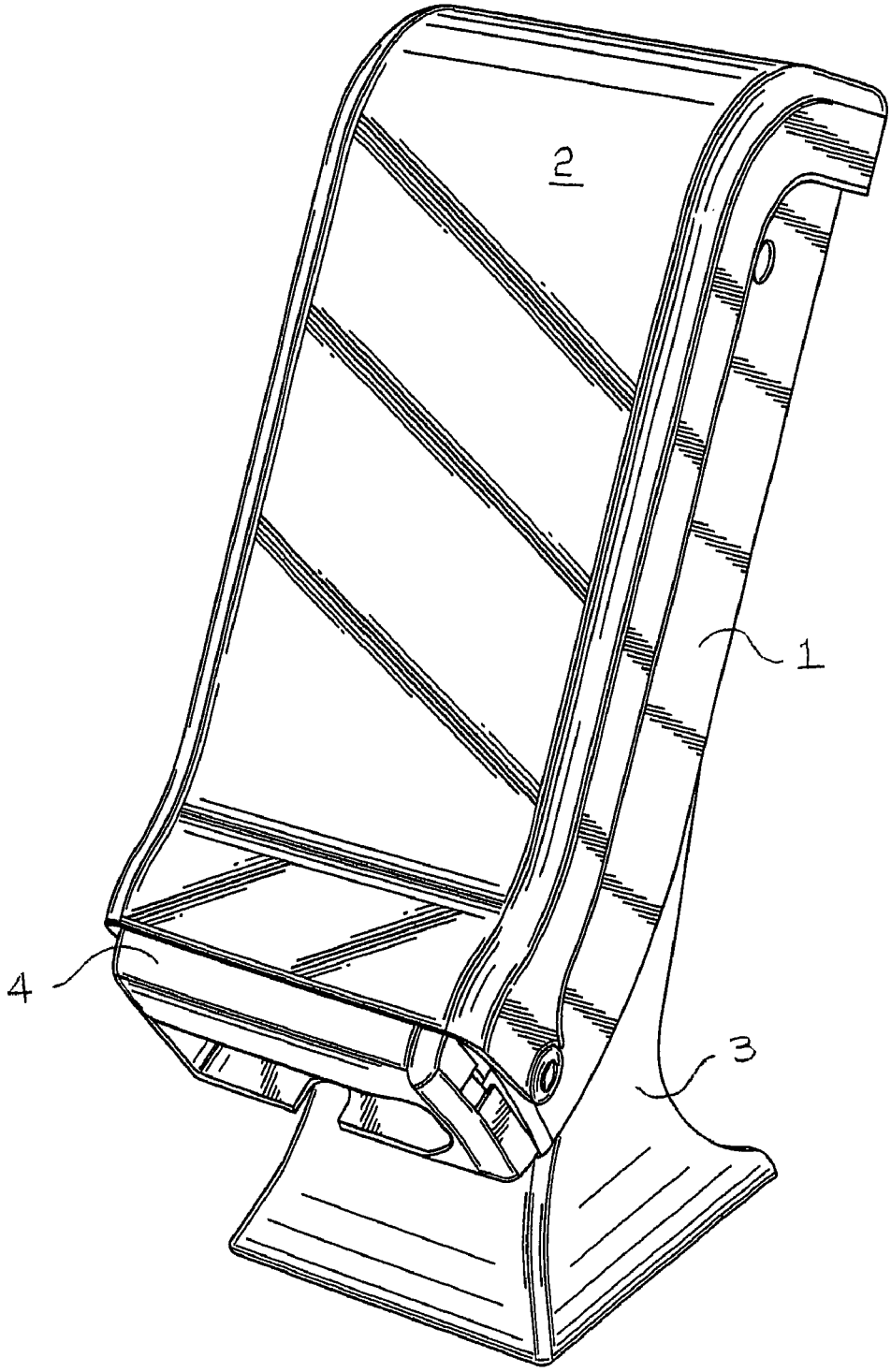
FIG. 1 is a perspective view showing an embodiment of a dispenser according to the present invention.

FIG. 1 shows a dispenser according to an embodiment of the invention. The FIG. 1 embodiment is intended to dispense paper napkins, but it will be appreciated that the dispenser according to the invention could also be used to dispense paper towels or tissues or other absorbent sheet products.

The term Aabsorbent sheet products@ as used herein embraces not only paper products such as paper napkins, but also absorbent nonwoven materials not normally classed as papers or tissues. Such nonwoven materials include pure nonwovens and hybrid nonwoven/pulp webs whose properties are similar to those of tissue paper, but which are based for example on nonwoven or airlaid materials containing low amounts of synthetic fibers, binders, wet strength agents and the like. An example of such a material would be a wetlaid or foam-formed hydraulically entangled nonwoven material comprising at least 30% by weight pulp fibers and at least 20% by weight manmade fibers or filaments.

Figure 3:
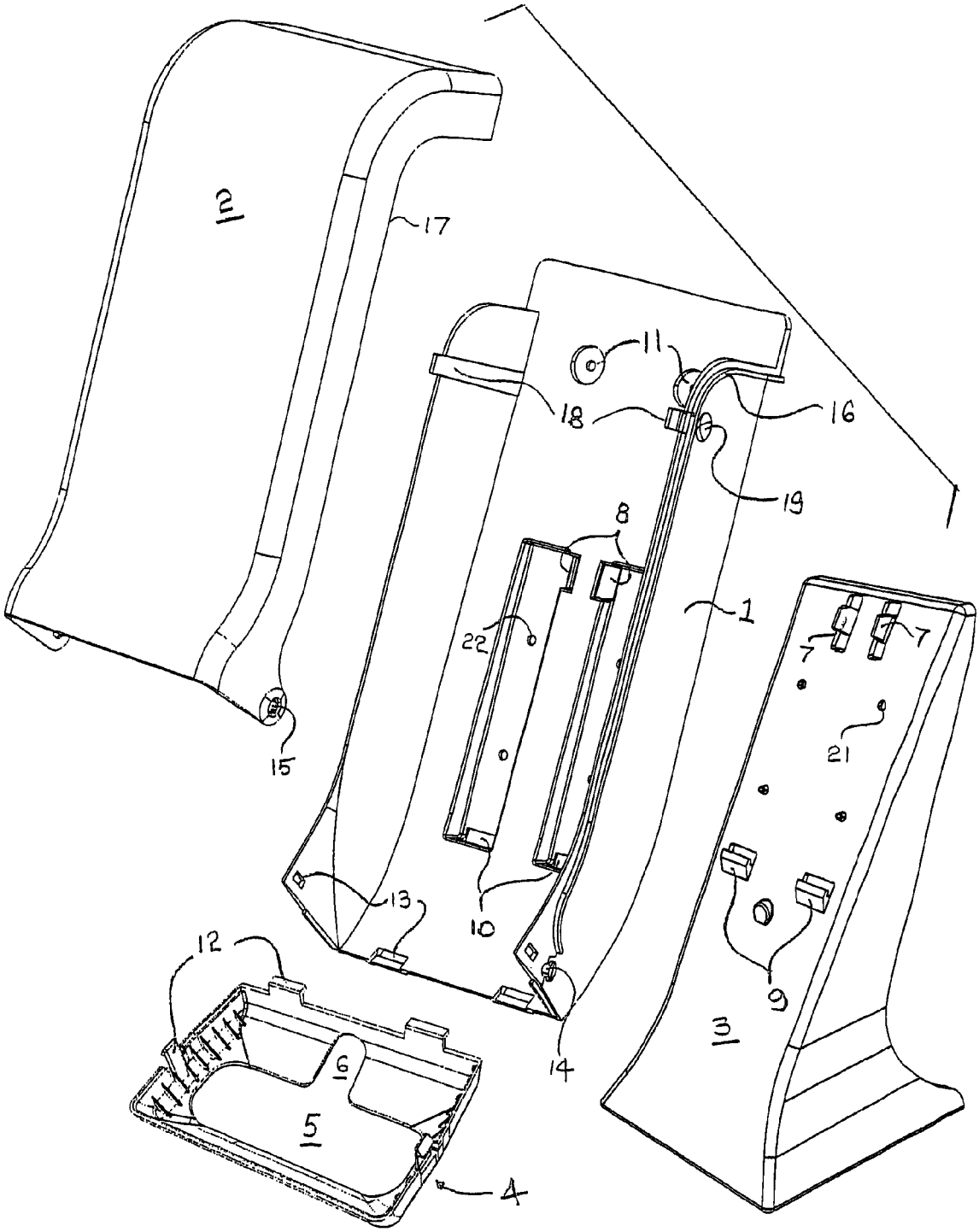
FIG. 3 is an exploded perspective view showing the principal components of the dispenser according to FIG.

The principal components of the dispenser in this embodiment include a main dispenser body portion 1, that terminates downwardly in a faceplate 4 having a dispensing opening through which napkins are withdrawn one-by-one. In this embodiment, the faceplate 4 is removable from the body portion 1, as shown in FIG. 3; however, the faceplate 4 could also be formed in one piece with, or permanently secured to, the main body portion 1.

A cover 2 closes the front of the main body portion 1, and is openable to permit reloading of fresh napkins into the main body portion 1. The cover 2 is preferably transparent, so that the quantity of napkins remaining in the dispenser can be observed without the need to open the same; whereas the main body portion 1 is preferably opaque.

A stand 3 supports the dispenser on an underlying horizontal surface, and also positions the dispenser at the desired angle relative to such surface. The stand 3 is preferably also removable from the body portion 1, as shown in FIG. 3, which provides advantages discussed herein; however, the stand 3 could also be formed in one piece with, or permanently secured to, the main body portion 1.

Figure 2:
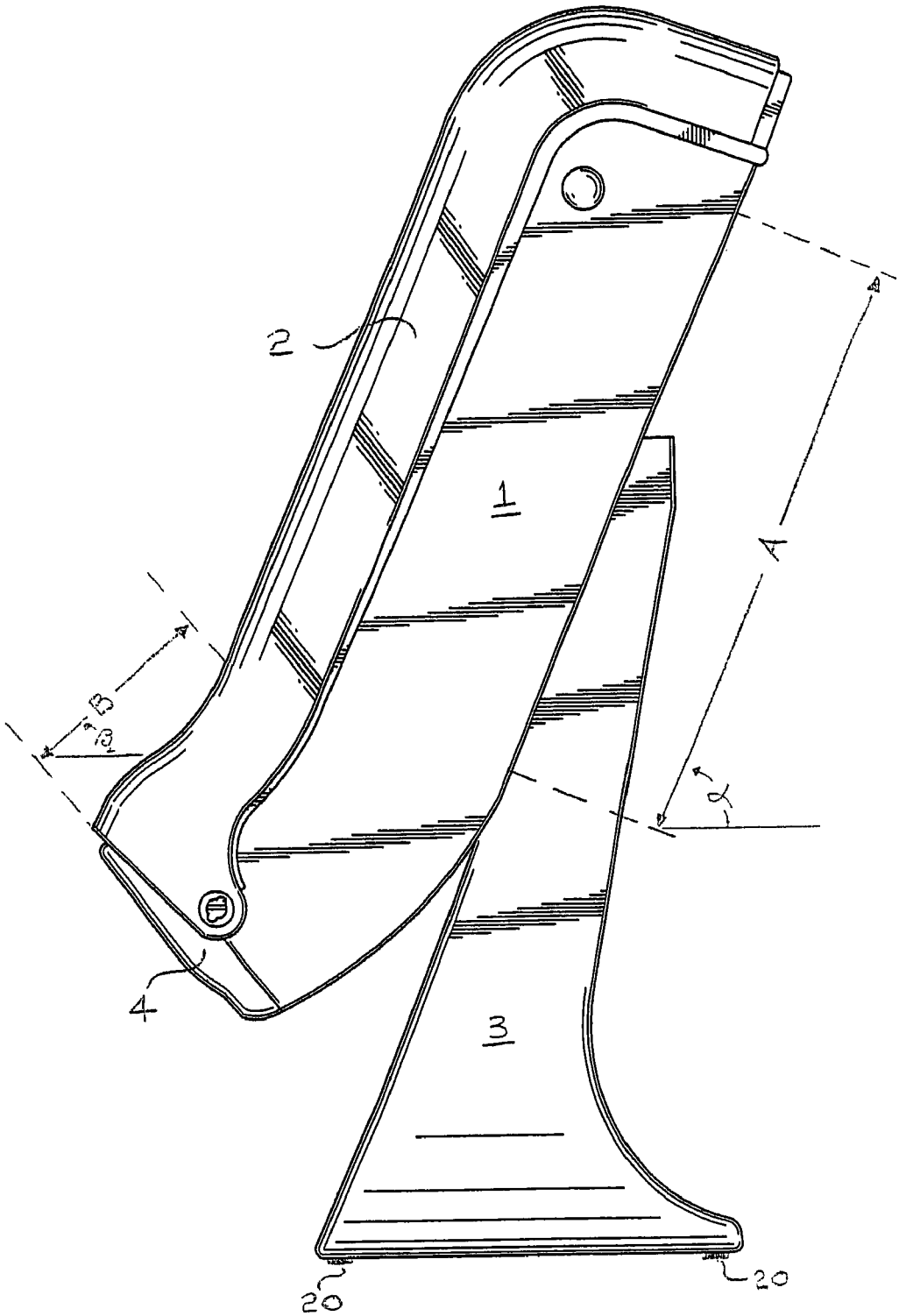
FIG. 2 is a side view showing the dispenser according to FIG. 1.

In FIG. 2, it can be seen that the dispenser body in this embodiment comprises basically two main sections, a generally straight upstream section A, and a shorter downstream section B, which can be straight or curved. The upstream section A extends over at least about half of the total length of the dispenser body from top to bottom, and preferably more than half.

The stand 3 positions each of the sections A and B at an oblique angle in relation to the underlying horizontal support surface. Section A extends generally at an angle $\alpha$, wherein section B extends generally at an angle $\beta$. To the extent that the outer contours of the housing are not entirely straight, as is the case for section B in this embodiment, the measure of the angle can be taken from a plane bisecting that portion of the napkin stack resident within the section in question, between the front and rear edges thereof.

Angle $\alpha$ is more nearly vertical than angle $\beta$, as is shown in FIG. 2. Angle $\alpha$ is preferably in the range from about 45° to about 85°, and more preferably about 600, as shown. Angle $\beta$ is preferably in the range from about 15° to about 60°, and more preferably about 45°, as shown.

As used herein, the term "sections" with reference to the dispenser body connotes a region encompassing most or all of the depth of the dispenser from front to back. Accordingly, each of the upstream and downstream sections A and B serves to turn the stack of napkins contained in the dispenser along the respective angle at which they extend.

In particular, the upstream section A permits housing a relatively large volume of napkins in a relatively small area of counter space. The downstream section B, by turning the napkin stack more toward the horizontal, permits the dispensing opening to be positioned closer to the horizontal support surface than would be acceptable in the case of a vertically oriented dispenser.

Consequently, the stand 3 can be made relatively compact, and the center of gravity of the overall dispenser is not undesirably high. The stand 3 therefore need not be made as large or heavy as some prior art vertically-oriented dispensers. Furthermore, although it is within the scope of the invention to mount the stand fixedly to the horizontal support surface, it is normally sufficient to have the stand 3 rest freely on such surface, in which case some type of frictional contact element(s) such as rubber feet 20 are preferably used.

The exploded view of FIG. 3 shows a number of advantageous structural details of the FIG. 1 embodiment. All of the components are preferably formed of injection-molded plastic. The various connecting structures of the component parts thereby have sufficient inherent resiliency to deform enough to enter the mating parts on the adjacent component, for ease of assembly and disassembly.

The transparent cover 2 is connected to the main body portion 1 via the slotted openings 15, which fit over the flanged bosses 14 formed on the main body portion 1. Only one opening/boss pair 14,15 is visible in FIG. 2; however, the dispenser of this embodiment is symmetrical about a longitudinal bisecting plane parallel to its sides. The cover can be opened by pivoting it about the common axis of the bosses 14 and openings 15. The range of angular movement of the cover 2 relative to the main body portion 1 permits fully exposing the interior of the main body portion 1, thereby to allow unimpeded access for refilling the dispenser.

Cleats 18 snap fit to the inside edge portions of cover 2 to hold the cover in the closed position. Those cleats can be released by exerting inwardly-directed pressure on the depressions 19 formed on the outside of the main body portion 1.

The cover 2 of this embodiment also has an inner width slightly greater than the outer width of the main body portion 1, so that the two components overlap in the closed position. The main body portion 1 therefore includes a laterally-outwardly projecting flange 16 on one or both sides, which registers with the complementary-shaped edge 17 of the cover 2, and serves as a secure stop in the closed position.

The main body portion 1 is closed at its lower end by a faceplate 4 having a dispensing opening 5. The faceplate 4 cooperates with the stack of napkins held within the dispenser to permit one-at-a-time dispensing of such napkins, as will be described in greater detail below. The faceplate 4 is detachably connected to the main body portion 1 by resilient cleats 12 that mate with corresponding slots 13 formed on the main body portion 1.

The main body portion 1 is detachably connected to the stand 3 by a combination of brackets 9 on the stand that engage slots 10 on the main body portion 1, resilient cleats 7 on the stand 3 that snap fit into corresponding openings 8 on the main body portion 1, and round projections 21 on the stand 3 that engage openings 22 on the main body portion 1 to ensure a correct positional registration.

The main body portion 1 also includes recessed openings 11 that permit the main body portion 1 to be fastened to a vertical support surface. In that case, the stand 3 would not be used. The dispenser of this embodiment may therefore be positioned on a horizontal surface by using the stand 3, or mounted on a vertical surface, without the stand 3. This is believed to provide a very advantageous measure of versatility for commercial food service establishments, and especially for fast food franchises, in that the dispenser could be used with the stand for indoor countertop use, and outdoors without the stand, fixed to the wall of a drive-through lane.

Figure 4A:
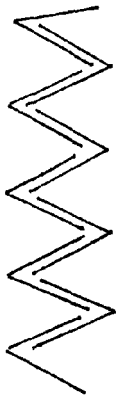
FIG. 4(*a*) is a schematic representation of the interfold configuration of the napkins used in the dispenser of FIG. 1.
Figure 4B:
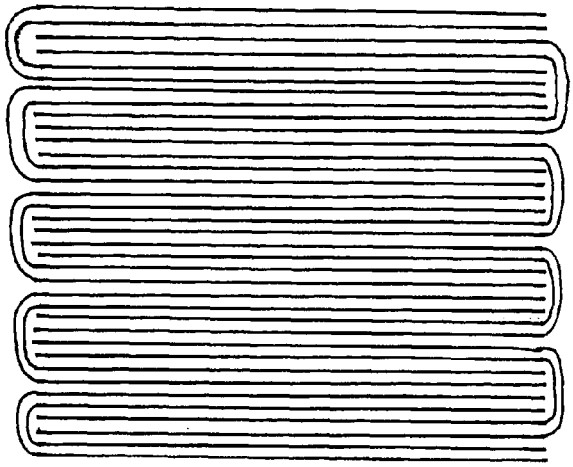

FIGS. 4(*a*) and 4(*b*) show in a schematic manner the napkins that it is presently preferred to use in conjunction with the dispenser of FIGS. 1-3. The napkins are interfolded in the manner illustrated schematically in FIG. 4(*a*). The napkins are preferably entirely separated from one another; however, those skilled in the art will appreciate that the interfolded product illustrated in FIG. 4(*a*) will be produced using two "lanes" or webs of napkin stock, such that alternate napkins may be interconnected by tabs at their adjacent respective leading and trailing edges, with the initial resistance force to withdrawal through the dispensing opening 5 being sufficient to tear the tabs and remove only a single napkin.

Each napkin is preferably "quarter-folded," meaning that it is folded along two perpendicular lines of folding, with each fold line preferably bisecting the sheet. An initial sheet of napkin stock is preferably about 13" by 8½", so the folded napkin would have dimensions of about 6½" by 4¼". It is preferred that the napkins be rectangular rather than square as folded, because, although the parallel sides of the interfolded napkin stack are identical, the perpendicular sides are not.

Therefore, the long sides of the folded napkins are parallel to the front and back surfaces of the dispenser, whereas the short sides of the folded napkins are parallel to the left and right sides of the dispenser. An advantage of this arrangement is that the napkin stack cannot be inserted "backward" or "upside-down" into the dispenser, as there is no distinction between the top and bottom of the napkin stack or between the parallel sides thereof.

FIGS. 4(*a*) and 4(*b*) are taken in planes parallel to the short sides of the napkin stack. FIG. 4(*b*) illustrates the point that each napkin is folded not only as shown in the figure, but also about a perpendicular line of folding parallel to or coincident with the plane of the drawing. Therefore, the folds visible in FIGS. 4(*a*) and 4(*b*) are those extending across the long dimension of the napkins, whereas the folds not visible are those extending across the short dimension of the napkins A quarter-fold interfolded arrangement has been described before in connection with pop-up tissue dispensers (see EP 0 286 538 B1 and EP 0 302 382 A1), but not previously for napkins in a gravity-fed, downwardly opening dispenser. Such a napkin is expected to be regarded by users as being of relatively high quality, because the presence of four panels permits conferring sufficient aggregate strength and flexibility to the napkin while using stock web material having a relatively low basis weight, which confers advantageous properties of drape and hand feel to the napkin.

In use, the napkin stack is loaded into the dispenser with the cover 2 in open position, after which the cover 2 is closed. A first napkin is withdrawn in whole or in part through the dispensing opening 5, with the aid of the side extension 6 thereof. The interfolding causes two adjacent panels of the next napkin to project through the dispensing opening, such that a user will be able to take only one napkin at a time. This dispensing mode discourages users from withdrawing more napkins than are needed, and correspondingly reduces waste.

When the dispenser is almost empty, the transparent cover 2 will reveal that condition to employees of the establishment, so that the dispenser can be refilled.

While the present invention has been described in connection with various preferred embodiments thereof, it is to be understood that those embodiments are provided merely to illustrate the invention, and should not be used as a pretext to limit the scope of protection conferred by the true scope and spirit of the appended claims.

What is claimed is:

1. A dispenser for holding and dispensing folded absorbent sheet products, the dispenser comprising a body and a stand, the stand comprising a base for supporting the dispenser on a horizontal surface, the body comprising two sections, wherein a first upstream one of said sections is straight and extends over the majority of the length of said body, and wherein a second downstream one of said sections extends at an angle relative to said first section and communicates with a dispensing opening, and wherein, when said dispenser is supported by said stand on said horizontal surface, each of said first and second sections forms an oblique angle relative to said horizontal surface, said first section forming an angle that is more nearly vertical, and said second section forming an angle that is more nearly horizontal.

2. The dispenser according to claim 1, wherein said stand is detachable from said body.

3. The dispenser according to claim 2, wherein said body comprises mounting structures for mounting said body on a vertical surface, such that said first straight section extends parallel to said vertical surface.

4. The dispenser according to claim 1, further comprising a stack of folded absorbent sheet products held within said body.

5. The dispenser according to claim 1, wherein said stand comprises attachment structures for fixing the dispenser to said horizontal surface.

6. The dispenser according to claim 1, wherein said stand comprises feet made of a resilient material for supporting the dispenser on said horizontal surface.

7. The dispenser according to claim 4, wherein said stack of folded absorbent sheet products are interfolded paper napkins.

8. The dispenser according to claim 1, wherein said angle formed by said first section is in the range of 45-85°.

9. The dispenser according to claim 8, wherein said angle formed by said first section is about 60°.

10. The dispenser according to claim 1, wherein said angle formed by said second section is in the range of 15-60°.

11. The dispenser according to claim 10, wherein said angle formed by said second section is about 45°.

12. The dispenser according to claim 3, wherein said mounting structures for mounting said body on a vertical surface comprise at least two openings formed in a rear wall of said body, for receiving bolts securing said body to said vertical surface.

13. The dispenser according to claim 1, wherein said body comprises a main portion and a cover, and wherein the cover is openable in relation to the main portion to expose an interior of said main portion over all of said first straight section.

14. The dispenser according to claim 13, wherein said main portion comprises peripheral flanges extending outwardly along at least part of said first section, and wherein edge regions of said cover, when closed, rest upon said flanges.

15. The dispenser according to claim 13, wherein said cover is transparent.

16. The dispenser according to claim 15, wherein said main portion is opaque.

* * * * *